US009049975B2

(12) United States Patent
Shinler

(10) Patent No.: US 9,049,975 B2
(45) Date of Patent: Jun. 9, 2015

(54) SURFACE MAINTENANCE VEHICLE WITH QUICK RELEASE SQUEEGEE ASSEMBLY

(71) Applicant: Tennant Company, Minneapolis, MN (US)

(72) Inventor: Kevin L. Shinler, Minnetonka, MN (US)

(73) Assignee: Tennant Company, Minneapolis, MN (US)

( * ) Notice: Subject to any disclaimer, the term of this patent is extended or adjusted under 35 U.S.C. 154(b) by 75 days.

(21) Appl. No.: 13/767,859

(22) Filed: Feb. 14, 2013

(65) Prior Publication Data

US 2013/0212813 A1 Aug. 22, 2013

Related U.S. Application Data

(60) Provisional application No. 61/599,773, filed on Feb. 16, 2012.

(51) Int. Cl.

| | |
|---|---|
| ***A47L 11/30*** | (2006.01) |
| ***A47L 11/28*** | (2006.01) |
| ***A47L 11/40*** | (2006.01) |

(52) U.S. Cl.

CPC ..... *A47L 11/28* (2013.01); *Y10T 29/49826* (2015.01); *A47L 11/4038* (2013.01); *A47L 11/4044* (2013.01)

(58) Field of Classification Search

CPC . A47L 11/28; A47L 11/4038; A47L 11/4044; Y10T 29/49826

USPC ..... 15/320, 401

IPC ..... A47L 11/30

See application file for complete search history.

(56) References Cited

U.S. PATENT DOCUMENTS

| | | | |
|---|---|---|---|
| 6,602,018 | B2 | 8/2003 | Feeny et al. |
| 6,705,332 | B2 | 3/2004 | Field et al. |
| 6,895,633 | B2 | 5/2005 | Tucker |
| 2007/0074369 | A1 | 4/2007 | Stuthers et al. |
| 2009/0064452 | A1 | 3/2009 | Thatcher et al. |

FOREIGN PATENT DOCUMENTS

| | | | |
|---|---|---|---|
| EP | 2248455 | A1 | 11/2010 |
| WO | 01/78909 | A1 | 10/2001 |
| WO | 2006/089307 | A2 | 8/2006 |

OTHER PUBLICATIONS

International Search Report and Written Opinion for PCT/US2013/026120, May 29, 2013, 10 pages.

*Primary Examiner* — David Redding

(74) *Attorney, Agent, or Firm* — Fredrikson & Byron P.A.

(57) ABSTRACT

A surface maintenance vehicle with quick release squeegee assembly and a method of connecting a squeegee assembly to the brush deck of a floor surface maintenance vehicle. A single release latch may be used to connect and disconnect the squeegee assembly and the brush deck. When engaged, corresponding locating structures on the brush deck and a frame of the squeegee assembly align the brush deck and the frame and provide points where the relative movement between the brush deck and frame are restricted.

23 Claims, 5 Drawing Sheets

SURFACE MAINTENANCE VEHICLE WITH QUICK RELEASE SQUEEGEE ASSEMBLY

PRIORITY CLAIM

The present application claims priority to U.S. Patent Provisional Application Ser. No. 61/599,773, filed Feb. 16, 2012, the disclosure of which is hereby incorporated by reference in its entirety.

FIELD OF THE INVENTION

The present invention generally relates to floor surface cleaning equipment. More particularly the present invention relates to a squeegee assembly having a novel attachment and quick release mechanism for use with such equipment.

BACKGROUND OF THE INVENTION

Surface maintenance vehicles are well known. These vehicles and devices may be self-powered, towed, or pushed, and/or manually powered and may carry a human operator during cleaning operations. Such vehicles include scrubbers, extractors, sweepers and vacuums, as well as combinations thereof, intended for cleaning, scrubbing, wiping and/or drying a portion of a substantially flat surface both indoors and outdoors. These devices typically include a source of cleaning solution, solution applying means for distributing cleaning solution onto the floor surface, scrubbing means for engaging a wetted floor surface and a vacuum system for removing soiled cleaning solution from the floor surface. The cleaning solution is typically supplied to the floor surface through or near rotary scrub brushes operating from a lower portion of the vehicle. The vacuum system typically includes one or more squeegee elements, such as disclosed in U.S. Pat. Nos. 6,895,633; 6,705,332 and 6,602,018, each being incorporated by referenced herein.

The squeegee assembly of such prior art cleaning vehicles often mounts at or near the rear of the surface maintenance vehicle to direct the solution to a removal location where the solution (including suspended dirt, particles and contaminants) is removed. The squeegee assembly may include a squeegee supporting member of generally arcuate configuration with two squeegee blades spaced apart and affixed to the supporting member to promote consistent contact with the surface to be cleaned and wiped.

In some prior art cleaning vehicles having two squeegee blades, a vacuum source may couple to the wiping assembly to lift the loaded cleaning solution from the space between the blades to a remote reservoir or other collection unit. The squeegee assembly is often sufficiently wide to at least fully cover the path width of the scrub brushes and/or the wheels of the cleaning vehicle. The ends of the squeegee assembly tend to be exposed at the sides of the vehicle and are therefore potentially vulnerable to contact with stationary objects which might be encountered during operation of the vehicle during cleaning operations and when transporting the vehicle between cleaning operations.

The squeegee blades in these types of machines are often a wear/service item. As the blades wear, the ability of the machine to pick up soiled cleaning solution and/or water is diminished. In some particularly harsh environments, squeegee blades are replaced multiple times during the life of the machine. Many times this is done by the operator in the field where the availability of tools is limited. Some prior art machines provide thumb screws for retaining the squeegee blades.

Tennant Company's model 433 Walk Behind Scrubber has included removable squeegee blades and retainers. In this design, the retainers and blades are connected together via fasteners. The design provides for tool-less blade exchange by increasing the clearance around the blades, so the blades could be pushed or pulled within a retainer-receiving channel.

Some prior art squeegee assembly couplings use a compliant bushing that has a portion of the bushing captured by the squeegee assembly and the remainder of the bushing captured in the squeegee suspension. A threaded fastener is used to secure the bushing between the squeegee assembly and the squeegee suspension. The pocket profile in the squeegee suspension allows for the through hardware to be released through an open ended slot profile and also incorporates a pocket for the portion of the compliant bushing. The through hardware will hold the assembly together for normal operation.

The threaded hardware of the prior art is difficult and time-consuming to work with, and is a burden to work with as it is located in a dirty environment and the threads become contaminated. In the past, squeegee disassembly and replacement of the blades has been a tedious, time consuming task. Thus, there is a need for an improved squeegee assembly which has improved assembly and disassembly features, possibly including an improved releasable coupling.

SUMMARY

Certain embodiments of the present invention include a floor maintenance vehicle with a quick release squeegee that includes a brush deck, a squeegee assembly, and a single release latch. The brush deck has a floor-engaging brush carried by the brush deck. The squeegee assembly includes at least one squeegee blade and a frame to which the squeegee blade is mounted. The squeegee blade is adapted to drag on the floor nearby the brush. The single release latch connects and secures the squeegee assembly to the brush deck. The squeegee assembly is removable from the brush deck when the single release latch is removed.

Certain embodiments of the present invention provide a method of connecting a squeegee assembly to the brush deck of a floor surface maintenance vehicle where the squeegee assembly includes at least one squeegee blade and a frame to which the at least one squeegee blade is mounted. The method includes engaging corresponding locating structures on the brush deck and the frame that align the frame relative to the brush deck and provide two or more points where the relative movement between the brush deck and frame are restricted. The method also includes engaging a single release latch to connect and secure the squeegee assembly to the brush deck where the squeegee assembly is removable from the brush deck when the single release latch is removed.

BRIEF DESCRIPTION OF THE DRAWINGS

The following drawings are illustrative of particular embodiments of the invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

Figure 1A:
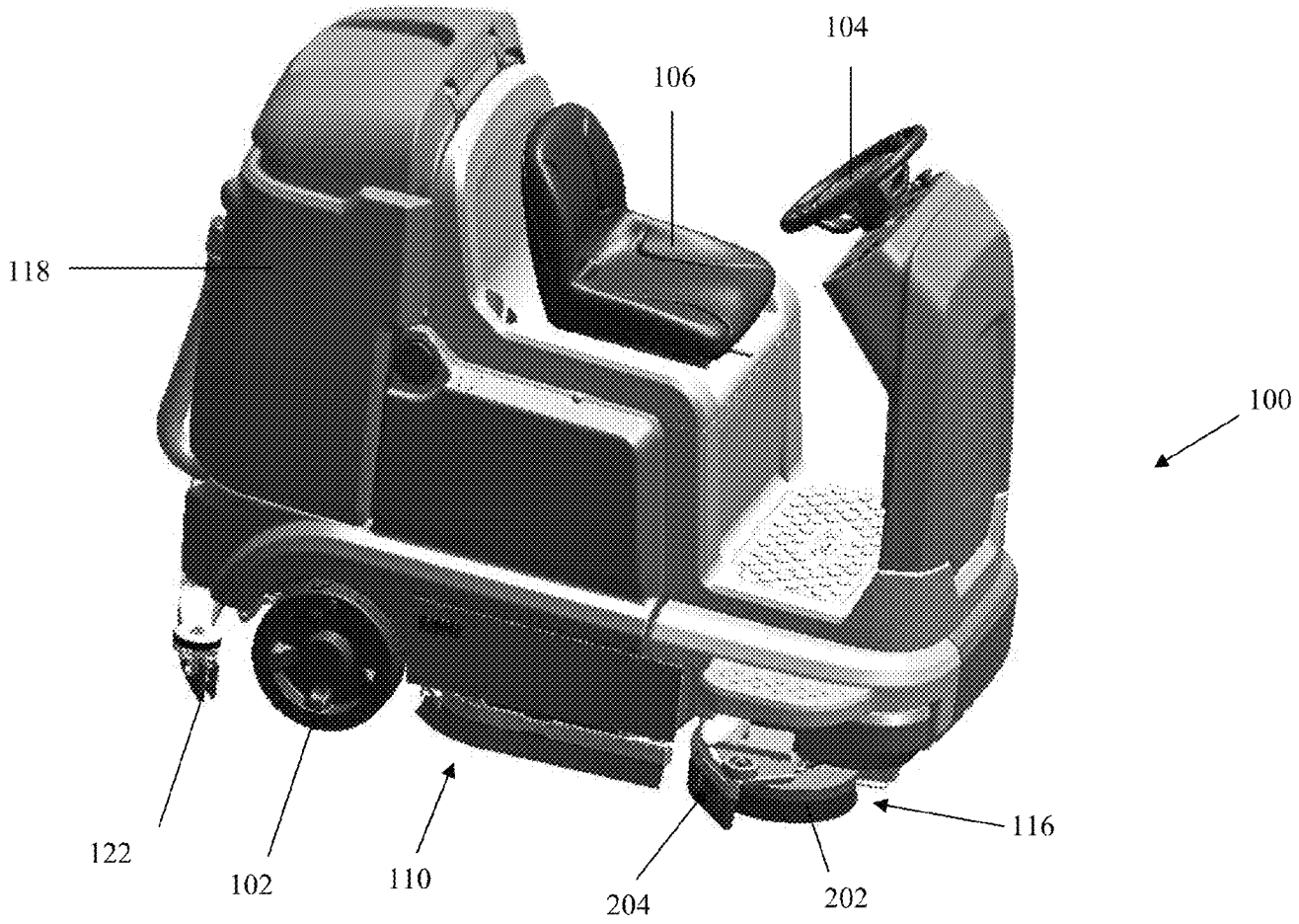
FIG. 1A is an upper perspective view of an exemplary floor surface cleaning machine employing an embodiment of the quick release squeegee attachment of the present invention attached to a side brush assembly.
Figure 1B:
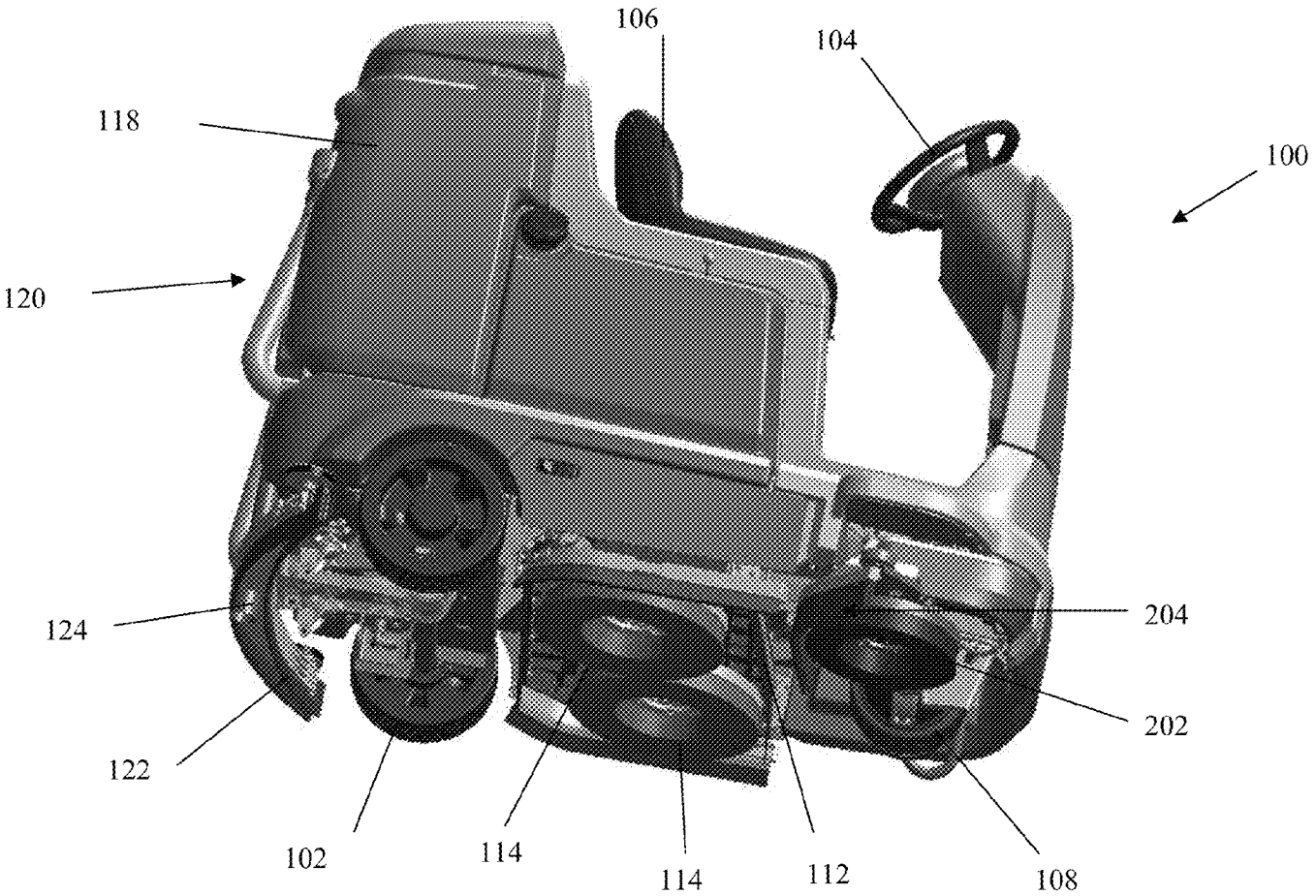
FIG. 1B is a lower perspective view of an exemplary floor surface cleaning machine employing an embodiment of the quick release squeegee attachment of the present invention attached to a side brush assembly.

FIGS. 1A-B are upper and lower perspective views, respectively, of an exemplary floor surface cleaning machine 100. Embodiments of the machine 100 include components that are supported on a motorized mobile body. The mobile body comprises a frame supported on wheels 102 for travel over a surface, on which a cleaning operation is to be performed. The mobile body includes operator controls and a steering wheel 104, which is positioned with respect to a seat 106 of machine 100, so that a seated operator of machine 100 may steer a front center wheel 108 of machine 100. Machine 100 is preferably powered by one or more batteries that may be contained in a compartment beneath the seat. Alternately, the power source may be an internal combustion engine, powered through an electrical cord, or one or more power cells, may be employed to power machine 100.

Cleaning components extend from an underside of the machine 100. For example, a scrub head 110 is shown located at a middle portion of machine 100. The scrub head 110 has a housing 112 that encloses two scrub brushes 114. The brushes 114 are driven by two electric motors. An electric actuator attached between the scrub head 110 and the housing 112 raises the scrub head 110 for transport, lowers it for work, and controls its down pressure on the floor. Additional aspects of the electric actuator and associated mechanical coupling are described in more detail hereinafter. The scrub head 110 uses two disk scrub brushes 114 rotating about parallel vertical axes. Alternatively, scrub heads may be made with only one disk scrub brush, or one or more cylindrical brushes rotating about horizontal axes. While a scrub head 110 is depicted in the drawing figures, any appliance or tool for providing surface maintenance, surface conditioning, and/or surface cleaning to a surface may be coupled to an associated machine or vehicle in accordance with the present invention.

Vehicle 100 includes a side brush assembly generally indicated as 116 for cleaning a larger floor envelope. Such side brush assemblies make it easier to clean near walls or other obstacles without damaging the machine or the wall while at the same time widening the cleaning path of the machine to increase productivity. The side brush assembly is mounted on the front, right side of machine 100 and swings outwardly away from the machine center and downwardly toward the surface to be cleaned.

During wet scrubbing operations, water or a cleaning liquid contained in a tank 118 is sprayed to the surface beneath machine 100, in proximity to the scrub head 110. Brushes 114 scrub the surface and the soiled cleaning liquid is then collected by a fluid recovery system and deposited in a waste recovery tank 120. One embodiment of the fluid recovery system of the machine 100 includes a vacuum squeegee mounted adjacent the rear end of the machine 100. The vacuum squeegee generally comprises a squeegee 122 that extends across the width of the machine 100 and a frame that supports the squeegee 122. The vacuum squeegee also includes a vacuum port 124 that is placed in vacuum communication with a vacuum fan. The vacuum fan operates to remove liquid and particle waste collected by the vacuum squeegee 122 for deposit in the waste recovery tank 120.

In alternate embodiments, the floor surface maintenance machines 100 may be combination sweeper and scrubber machines. In such embodiments, in addition to the elements describe above, the machines 100 may also include sweeping brushes and a hopper extending from the underside of the machine 100, with the sweeping brushes designed to direct dirt and debris into the hopper. In still other embodiments, the machine 100 may be a sweeper only. In such embodiments, the machine 100 may include the elements as described above for a sweeper and scrubber machine, but would not include the scrubbing elements such as scrubbers, squeegees and fluid storage tanks (for detergent, recovered fluid and clean water). Alternatively, the machine 100 may be designed for use by an operator that walks behind the machine, or the machine may be configured to be towed behind a vehicle.

Figure 2:
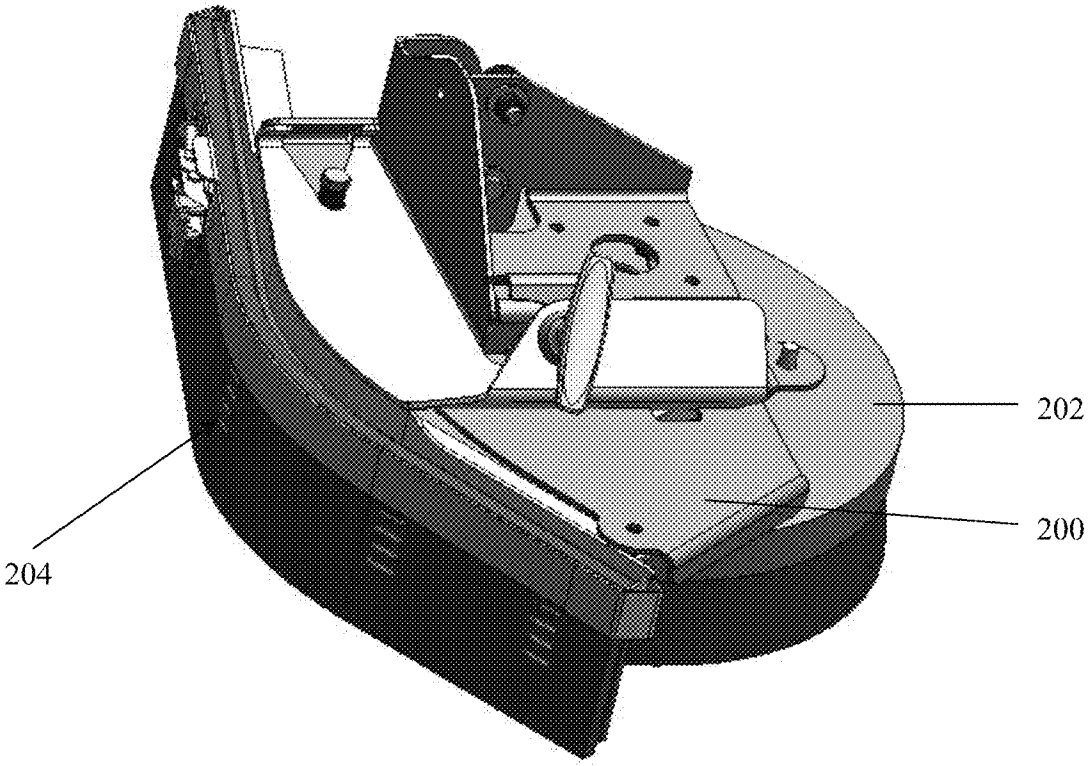
FIG. 2 is a right-side perspective view of an embodiment of the quick release squeegee attachment of the present invention attached to portions of a side brush assembly.

FIG. 2 is a perspective view taken from the upper right-side of vehicle 100 illustrating portions of side brush assembly 116, with certain components, such as the brush motor motor, omitted for clarity. Side brush assembly 116 includes a brush deck 200 having an electric-powered floor brush 202 for engaging a floor surface during side brush assembly 116 operation. The side brush assembly 116 includes a mechanism (not shown) for extending the side brush assembly 116 outwardly, away from a machine centerline, and for lowering brush 202 into floor surface contact. Activation of the mechanism is preferably achieved through a switch accessible at a user control panel. Side brush assembly 116 includes a squeegee assembly 204 which drags on the floor along the sides of brush 202 to keep scrub water on the floor from spreading out sidewise away from the machine 100. The squeegee assembly curves inward at its rear end to direct the water centrally to the machine 100 back to the scrub head 110 and back to the vacuum squeegee 122. Side brush assembly 116 is designed to "float" relative to machine 100, thereby keeping brush 202 in contact with the surface being cleaned even if the surface is somewhat irregular or uneven. Since squeegee assembly 204 forms part of side brush assembly 116, squeegee assembly 204 also floats relative to machine 100 to enable the squeegee assembly 204 to remain in contact with surfaces being cleaned, even though they are somewhat irregular or uneven. As described further below, embodiments of the invention provide for quick and simple release and attachment of the squeegee assembly to machine 100 such that replacement of its blades is much quicker and simpler. With the actuation of a single release handle, the squeegee assembly 204 can be removed from the machine 100 and serviced at a convenient location of the operator's discretion.

Figure 3:
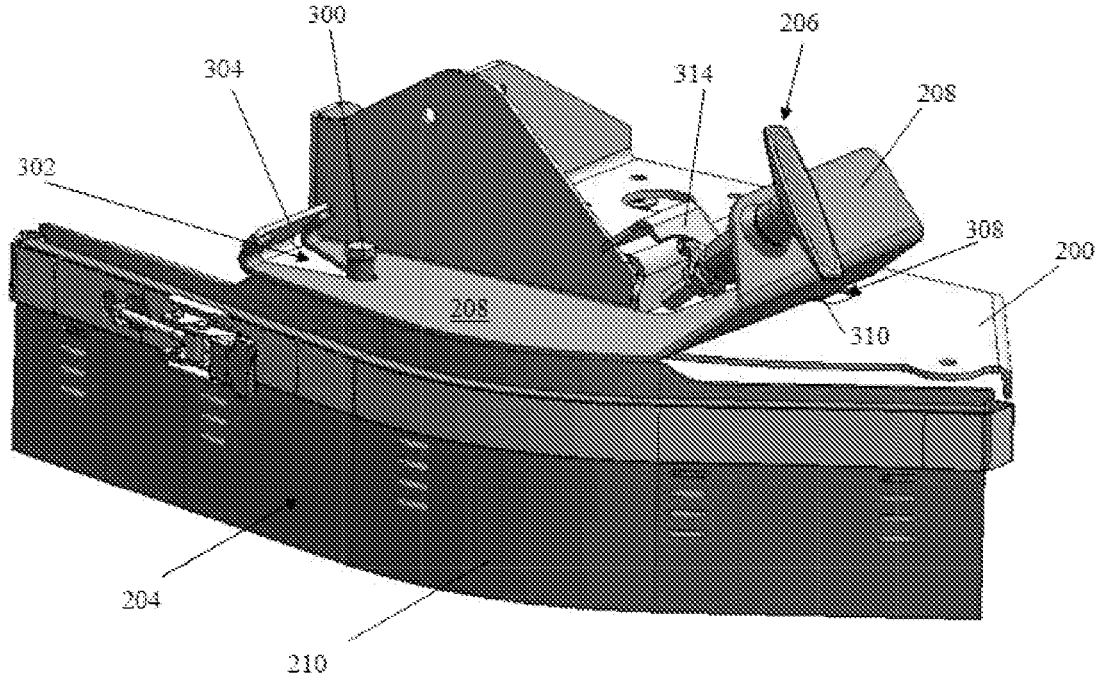
FIG. 3 is a rear view of an embodiment of the quick release squeegee attachment of the present invention attached to portions of a side brush assembly.
Figure 5:
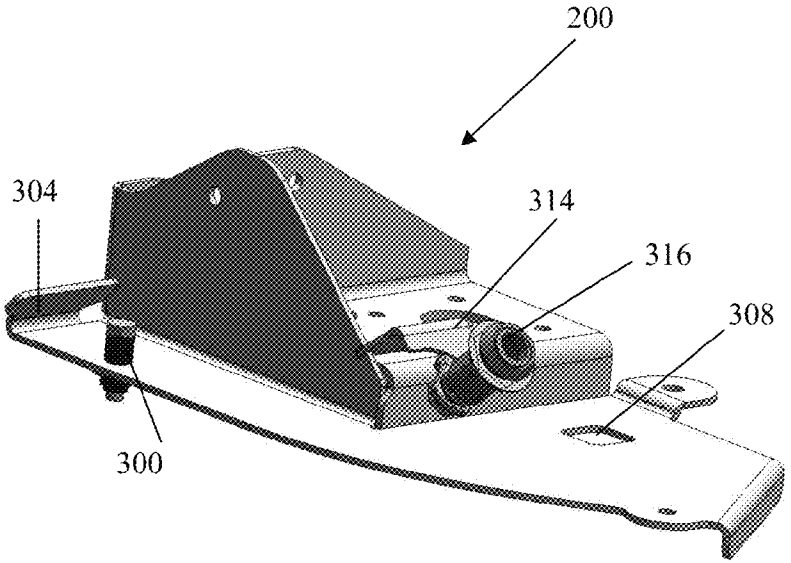
FIG. 5 is a perspective view of a brush deck illustrating portions of an embodiment of the quick release squeegee attachment of the present invention.
Figure 4:
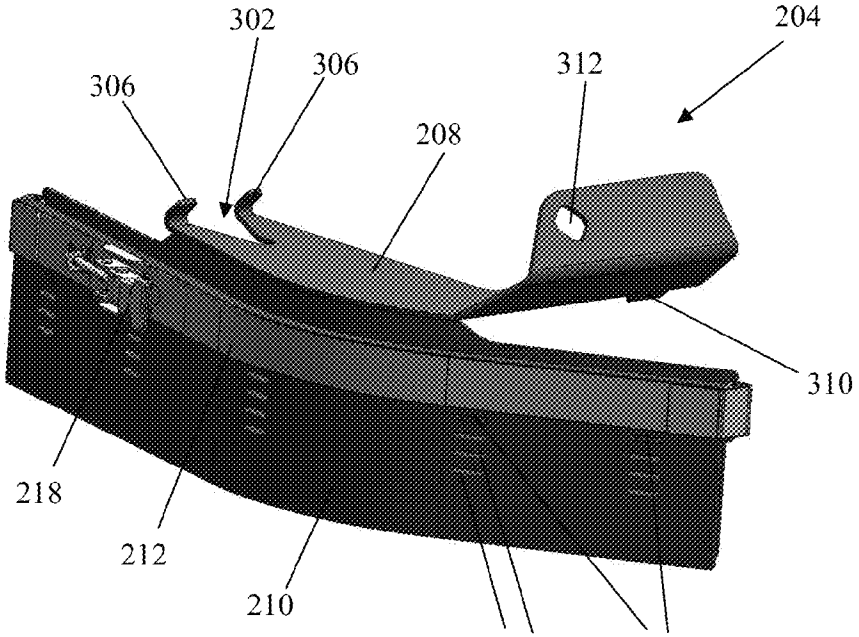
FIG. 4 is a perspective view of a squeegee assembly illustrating portions of an embodiment of the quick release squeegee attachment of the present invention.
Figure 6:
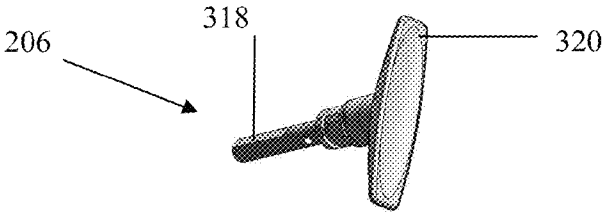
FIG. 6 is a perspective view of a release latch illustrating portions of an embodiment of the quick release squeegee attachment of the present invention.

FIG. 3 is a rear view of portions of the side brush assembly 116, with certain components, such as the brush motor and brush 202 omitted for clarity. FIGS. 4-6 are perspective views of the side brush assembly 116 components illustrated in FIG. 3 shown disassembled and separated. For instance, FIG. 4 is a perspective view of the squeegee assembly 204 shown in FIGS. 3 and 4. FIG. 5 is a perspective view brush deck 200 shown in FIGS. 3 and 4. FIG. 6 is a perspective view of a release latch 206.

Referring to FIGS. 3-6, squeegee assembly 204 includes frame 208, squeegee blades 210, and clamp band 212. Blades 210 may include one or more flexible blades that may be spaced apart or tight against each other. Blades 210 contact the floor surface and are made from suitable material such as gum rubber, neoprene, urethane, or the like. The one or more flexible blades may be of the same or of differing thicknesses, have differing levels of flexibility, and may have differing lower extents.

Blades 210 include multiple rows of open slots 214 that extend along the height of each blade 210. Frame 208 has a series of protruding tabs 216 that extend through one of the rows of open slots 214. The row of slots 214 used by the tabs 216 dictates the height of the blade relative to the frame 208. That is, if the tabs extend through a lower row of slots 214, the blade 210 bottom will be higher relative to the frame 208. Blades 210 are held against frame 208 via clamp band 212. Clamp band 212 includes a movable latch 218 that may be selectively manipulated to tighten clamp band 212 and secure it, along with blades 210, to frame 208.

The squeegee assembly 204 has several locating structures that cooperate with corresponding locating structures on brush deck 200 to provide a quick and simple connection and separation. Corresponding locating structures on the brush deck 200 and the frame 208 align the frame 208 relative to the brush deck 200 for normal use and operation of the vehicle. Each set of corresponding locating structures on the brush deck 200 and the frame 208 also form a point where relative movement (e.g., rotational, sliding, etc.) between the brush deck 200 and the frame 208 are restricted. In some embodiments two or more of such points are employed. In certain embodiments, three or more of such points are employed. In certain embodiments where two or more points are employed, at least two of such points are non-collinear with the location where the single release latch 206 is employed, in order to better reduce the amount of potential relative movement between the brush deck 200 and the frame 300 before the single release latch is engaged, which completes and secures the connection. In certain embodiments where three or more points are employed, at least three of such points are located in non-collinear locations in order to better reduce the amount of potential relative movement between the brush deck 200 and the frame 300 before the single release latch is engaged, which completes and secures the connection.

As described further below, brush deck 200 has a pin 300 that cooperates with a v-shaped slot 302 on frame 208 to form a set of cooperating locating structures. Brush deck 200 also has a tapered wedge 304 that cooperates with v-shaped tabs 306 on the frame 208 to form a set of cooperating locating structures. Brush deck 200 also has an open slot 308 that cooperates with downward directed tab 310 on frame 208 to form another set of cooperating locating structures. Although these cooperating structures are shown and described as one embodiment, it is understood that such sets of cooperating structures may be mixed and matched and other types of cooperating locating structures may be employed. Such sets of cooperating structures preferably work well in combination thereby each set of locating structures to be engaged either simultaneously or in combination and to align the frame 208 relative to the brush deck 200 and to form points where relative movement between the frame 208 and brush deck 200 are restricted.

Also, as described further below, frame 208 has an aperture 312 through which a release latch 206 may be inserted and secured in place to a pawl 314 fixed to brush deck 200. With the mere actuation of the single release latch 206, the squeegee assembly may be fixed to or released from brush deck 200.

When installing squeegee assembly to machine 100, first the squeegee assembly 204 can be located correctly by moving v-shaped slot 302 towards pin 300 until pin strikes the vertex or base of the v-shaped slot 302. Simultaneous with the movement of the v-shaped slot 302 towards pin 300, the v-shaped tabs 306 are directed towards the tapered wedge 304. The taper of the tapered wedge 304 and v-shape of the v-shaped tabs 306 cooperate to hold the underside (not shown) of the frame 208 against the top surface (shown in the drawing figures) of the brush deck 200. In addition, the pin 300 in slot 302 combines with the two contact points provided by the two v-shaped tabs 306 against the tapered wedge 304 to provide three, non-collinear points of stability between the frame 208 and the brush deck 200.

Next, when installing the squeegee assembly 204 to the brush deck 200, the tab 310 on the frame may be inserted downward into the open slot 308 in the brush deck. The tab 310 in the open slot 308 provides additional structure to resist squeegee assembly 204 movement, including resisting forces pushing the squeegee assembly rearward, such as when the machine is moving forward and the squeegee blades 210 encounter an obstruction.

After the tab 310 is inserted into the open slot 308, and after the pin 300 in slot 302 combines with the two contact points provided by the two v-shaped tabs 306 against the tapered wedge 304 to provide three, non-collinear points of stability between the frame 208 and the brush deck 200, the aperture 312 on frame 208 will align or almost align with the opening 316 of the pawl on brush deck 200. The pin 318 of releasable latch 206 can be inserted through aperture 312 and through opening 316 and secured to pawl 314, in certain embodiments, with merely a 180 degree rotation of the handle 320 of release latch 206. The act of securing release latch 206 to pawl 314 functions not only to hold the frame 208 against the top of the brush deck 200, but it also drives the v-shaped tabs 306 further into the tapered wedge 304.

To disconnect the squeegee assembly 204 from the machine 100, the reverse steps may be followed. Accordingly, a user need only twist the handle 320 of release latch 206 in order to separate the squeegee assembly 204 from the brush deck 200. In past designs, past squeegee assemblies employed multiple threaded knobs and corresponding threaded posts to secure squeegee assemblies to a machine. Multiple knobs will hold the squeegee frame in place in multiple directions. However, the location of the knobs subjects such knobs to moisture and dirt. Such moisture and dirt create a greasy and unwelcoming environment for a typical user who must periodically service the squeegee assemblies. The ability to connect and disconnect the squeegee assembly via a single release handle is a quicker and easier solution.

In alternate embodiments, the function and benefits of connection between the pin 300 and the v-shaped slot 302 may be replaced by other corresponding locating structures, such as a tab and slot connection, where the tab and the slot could be located on the brush deck 200 and the frame 208, respectively or vice versa. In another embodiment, the entire extent of the frame could be captured by external features. In alternate embodiments, the function and benefits of connection between tapered wedge 304 and v-shaped tabs 306 could be replaced by other corresponding locating structures, such as another tab and slot connection or other type of pinch type action. In alternate embodiments, the function and benefits of connection between open slot 308 and downward directed tab 310 could be replaced by a different type of corresponding locating structures, such as tabs and slots that are oriented in directions other than that shown in the drawing figures. A pin and slot could also be substituted in place as corresponding locating structures. In alternate embodiments, the function and benefits of connection between aperture 312, pawl 314, and releasable handle 320 can be replaced with other latches, such as a roller cam on a ramp or a sliding pawl on a ramp. Moreover, the connection and release provided by a twist motion, as described above with reference to handle 320, is not the only manner with which to provide this function. Other paddle latches or draw down types of holders could be substituted in and provide the simple and quick connection and release of releasable latch 206. The benefit provided by each of these mechanisms is that only a single actuation (of handle or other devices) is necessary to connect and release the squeegee assembly from the machine 100.

While the figures illustrate squeegee assembly 204 positioned relative to a side brush assembly, the squeegee assembly 204 may also find application adjacent the scrub head 110 or at the rear of machine 100 as the vacuum squeegee 122. As a result, aspects of the present invention may be embodied on a scrub head squeegee assembly or a rear-mounted squeegee assembly for a floor cleaning machine.

In the foregoing detailed description, the invention has been described with reference to specific embodiments. However, it may be appreciated that various modifications and changes can be made without departing from the scope of the invention.

The invention claimed is:

1. A floor surface maintenance vehicle with a quick release squeegee, comprising:

a brush deck with a floor-engaging brush carried by the brush deck;

a squeegee assembly having at least one squeegee blade and a frame to which the at least one squeegee blade is mounted, the at least one squeegee blade adapted to drag on the underlying floor proximate the brush, the brush deck and the frame including corresponding locating structures that, when engaged together, align the frame relative to the brush deck and provide two or more points where the relative movement between the brush deck and the frame are restricted; and a single release latch that connects and secures the squeegee assembly to the brush deck, the squeegee assembly being removable from the brush deck when the single release latch is removed.

2. The floor surface maintenance vehicle of claim 1, wherein the two or more points are not collinear with a location where the single release latch connects and secures the squeegee assembly to the brush deck.

3. The floor surface maintenance vehicle of claim 1, wherein, when the corresponding locating structures of the brush deck and the frame are engaged together to form the two or more points and to align the frame relative to the brush deck, an aperture of the frame aligns with a pawl on the brush deck to receive the single release latch that connects and secures the squeegee assembly to the brush deck.

4. The floor surface maintenance vehicle of claim 3, wherein the two or more points are not collinear with a location where the aperture of the frame aligns with the pawl on the brush deck.

5. The floor surface maintenance vehicle of claim 1, wherein the brush deck includes a tapered wedge that forms one of the locating structures and the frame includes one or more tabs that forms another one of the locating structures, the tapered wedge adapted to receive and hold the tabs to align the brush deck and the frame and to restrict relative movement between the brush deck and the frame.

6. The floor surface maintenance vehicle of claim 5, wherein the one or more tabs are v-shaped.

7. The floor surface maintenance vehicle of claim 1, wherein the brush deck includes an upstanding pin that forms one of the locating structures and the frame includes a progressively narrowing slot that forms another one of the locating structures, the progressively narrowing slot adapted to receive the upstanding pin to align the brush deck and the frame and to restrict relative movement between the brush deck and the frame.

8. The floor surface maintenance vehicle of claim 7, wherein the progressively narrowing slot is v-shaped.

9. The floor surface maintenance vehicle of claim 1, wherein brush deck includes an open slot that forms one of the locating structures and the frame includes a downward directed tab that forms another one of the locating structures, the open slot adapted to receive the downward directed tab to align the brush deck and the frame and to restrict relative movement between the brush deck and the frame.

10. A method of connecting a squeegee assembly to the brush deck of a floor surface maintenance vehicle, the squeegee assembly having at least one squeegee blade and a frame to which the at least one squeegee blade is mounted, comprising:

engaging corresponding locating structures on the brush deck and the frame that each align the frame relative to the brush deck and provide two or more points where the relative movement between the brush deck and frame are restricted; and engaging a single release latch to connect and secure the squeegee assembly to the brush deck, the squeegee assembly being removable from the brush deck when the single release latch is removed.

11. The method claim 10, wherein the two or more points are not collinear with a location where the single release latch connects and secures the squeegee assembly to the brush deck.

12. The method of claim 10, wherein the two or more points are three or more points and where the three or more points are non-collinear.

13. The method claim 10, wherein aligning the frame relative to the brush deck by engaging corresponding locating structures on the brush deck and the frame also aligns an aperture of the frame with a pawl on the brush deck in order to receive the single release latch.

14. The method claim 13, further comprising inserting a pin of the single release latch through the aperture and into the pawl connects and secures the squeegee assembly to the brush deck.

15. The method of claim 10, wherein the corresponding locating structures on the brush deck and frame includes a tapered wedge on the brush deck and one or more tabs on the frame, and the engaging corresponding structures includes inserting the tabs into the tapered wedge to align the frame relative to the brush deck and form one of the points that restricts relative movement between the brush deck and the frame.

16. The method of claim 10, wherein corresponding structures on the brush deck and frame includes an upstanding pin on the brush deck and a v-shaped slot on the frame, and the engaging corresponding structures includes inserting the upstanding pin into the v-shaped slot to align the frame relative to the brush deck and to form one of the points that restricts relative movement between the brush deck and the frame.

17. The method of claim 10, wherein corresponding structures on the brush deck and frame includes an open slot on the brush deck and a downward directed tab, and the engaging corresponding structures includes inserting the downward directed tab into the open slot to align the frame relative to the brush deck and to form one of the points that restricts relative movement between the brush deck and the frame.

18. A floor surface maintenance vehicle with a quick release squeegee, comprising:

a brush deck with a floor-engaging brush carried by the brush deck;

a squeegee assembly having at least one squeegee blade and a frame to which the at least one squeegee blade is mounted, the at least one squeegee blade adapted to drag on the underlying floor proximate the brush, the brush deck and squeegee assembly forming a side brush assembly of the floor surface maintenance vehicle; and a single release latch that connects and secures the squeegee assembly to the brush deck, the squeegee assembly being removable from the brush deck when the single release latch is removed.

19. A floor surface maintenance machine with a quick release squeegee, comprising:

a brush deck with a floor-engaging brush carried by the brush deck, the brush deck including a pawl;

a squeegee assembly having at least one squeegee blade and a frame to which the at least one squeegee blade is mounted, the at least one squeegee blade adapted to drag on the underlying floor proximate the brush, the frame includes an aperture; and a single release latch extending through the aperture of the frame to be releasably received into the pawl to connect and secure the squeegee assembly to the brush deck, the squeegee assembly being removable from the brush deck when the single release latch is removed.

20. A floor surface maintenance machine with a quick release squeegee, comprising:

a brush deck with a floor-engaging brush carried by the brush deck;

a squeegee assembly having at least one squeegee blade and a frame to which the at least one squeegee blade is mounted, the at least one squeegee blade includes two or more rows of open slots and the frame includes a series of protruding tabs that extend through corresponding open slots of one of the rows of open slots to help secure the at least one squeegee blade to the frame, the at least one squeegee blade adapted to drag on the underlying floor proximate the brush; and a single release latch that connects and secures the squeegee assembly to the brush deck, the squeegee assembly being removable from the brush deck when the single release latch is removed.

21. The floor surface maintenance vehicle of claim 20, wherein the height of the at least one squeegee blade relative to the underlying floor is adjustable by extending the series of protruding tabs through corresponding open slots of a different one of the rows of open slots, whereby the position of at least one squeegee blade relative to the frame varies based on which row of open slots connects to the series of protruding tabs.

22. The floor surface maintenance vehicle of claim 20, wherein squeegee assembly also includes a clamp band that clamps the at least one squeegee blade to the frame.

23. The floor surface maintenance vehicle of claim 22, wherein the clamp band includes a selectively releasable latch that tightens clamp band to secure the clamp band and the at least one squeegee blade to the frame.

* * * * *